US012571082B2

(12) United States Patent
Dong et al.

(10) Patent No.: US 12,571,082 B2
(45) Date of Patent: Mar. 10, 2026

(54) HIGH STRENGTH AND HIGH PLASTICITY HOT-FORMING STEEL WITH OXIDATION RESISTANCE FOR AUTOMOBILES AND HOT-FORMING PROCESS

(71) Applicant: ANGANG STEEL COMPANY LIMITED, Anshan (CN)

(72) Inventors: Yi Dong, Anshan (CN); Rendong Liu, Anshan (CN); Xiaoguang Shi, Anshan (CN); Chengqian Sun, Anshan (CN); Junxiong Wang, Anshan (CN); Chufei Han, Anshan (CN)

(73) Assignee: ANGANG STEEL COMPANY LIMITED, Anshan (CN)

( * ) Notice: Subject to any disclaimer, the term of this patent is extended or adjusted under 35 U.S.C. 154(b) by 507 days.

(21) Appl. No.: 18/025,277

(22) PCT Filed: Nov. 25, 2021

(86) PCT No.: PCT/CN2021/132954
§ 371 (c)(1),
(2) Date: Mar. 8, 2023

(87) PCT Pub. No.: WO2023/087351
PCT Pub. Date: May 25, 2023

(65) Prior Publication Data

US 2024/0167136 A1 May 23, 2024

(30) Foreign Application Priority Data

Nov. 19, 2021 (CN) ..... 202111401625.5

(51) Int. Cl.

| | |
|---|---|
| ***C22C 38/38*** | (2006.01) |
| ***C21D 6/00*** | (2006.01) |
| ***C21D 7/13*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |

(52) U.S. Cl.
CPC ..... *C22C 38/38* (2013.01); *C21D 6/002* (2013.01); *C21D 7/13* (2013.01); *C22C 38/002* (2013.01); *C22C 38/02* (2013.01); *C22C 38/06* (2013.01); *C22C 38/22* (2013.01); *C22C 38/24* (2013.01); *C22C 38/26* (2013.01); *C22C 38/28* (2013.01); *C21D 2211/001* (2013.01); *C21D 2211/005* (2013.01); *C21D 2211/008* (2013.01)

(58) Field of Classification Search
CPC ..... C22C 38/001; C22C 38/002; C22C 38/02; C22C 38/06; C22C 38/22; C22C 38/24; C22C 38/26; C22C 38/28; C22C 38/32; C22C 38/38; C22C 38/04; C21D 1/18; C21D 1/19; C21D 1/20; C21D 1/673; C21D 2211/00; C21D 2211/001; C21D 2211/005; C21D 2211/008; C21D 6/002; C21D 6/005; C21D 7/13; C21D 8/005; C21D 8/0226; C21D 8/0236; C21D 9/0068; C21D 9/46
See application file for complete search history.

(56) References Cited

FOREIGN PATENT DOCUMENTS

| | | | | | |
|---|---|---|---|---|---|
| CN | 103614640 | A | | 3/2014 | |
| CN | 103805840 | A | | 5/2014 | |
| CN | 103255340 | B | | 8/2015 | |
| CN | 106811689 | B | | 6/2017 | |
| CN | 106119693 | B | | 1/2018 | |
| CN | 106119694 | A | | 2/2018 | |
| CN | 108642373 | A | | 10/2018 | |
| CN | 109972061 | A | | 7/2019 | |
| CN | 110643909 | A | | 1/2020 | |
| CN | 111893377 | A | * | 11/2020 | ..... C23C 2/12 |
| CN | 111926248 | A | | 11/2020 | |
| CN | 113106338 | A | | 7/2021 | |
| CN | 113388773 | A | | 9/2021 | |
| JP | 2001226744 | A | | 8/2001 | |

* cited by examiner

*Primary Examiner* — Anthony M Liang
(74) *Attorney, Agent, or Firm* — MUNCY, GEISSLER, OLDS & LOWE, P.C.

(57) ABSTRACT

Provided are a high-strength and high-plasticity hot-forming steel with oxidation resistance for automobiles and a hot-forming process thereof, and the hot-forming steel has chemical compositions in mass percentages as follows: C: 0.35%-50%, Si: ≤0.20%, Mn: 1.50%-2.50%, P: 0.050%-0.10%, S≤0.004%, Als: 0.02%-0.06%, Nb: 0.03%-0.07%, Ti: 0.020%-0.050%, V: 0.08%-0.15%, Cr: 1.50%-3.20%, Mo: 0.10%-0.30%, B: ≤0.0040%, N≤0.005%, the balance Fe and inevitable impurities. The hot-forming steel provided in the present invention has high oxidation resistance, high strength and plasticity, does not need atmosphere protection during hot forming, and does not need shot blasting treatment after hot forming.

10 Claims, No Drawings

HIGH STRENGTH AND HIGH PLASTICITY HOT-FORMING STEEL WITH OXIDATION RESISTANCE FOR AUTOMOBILES AND HOT-FORMING PROCESS

TECHNICAL FIELD

The present invention relates to the technical field of automobile steel, in particularly to a high-strength and high-plasticity hot-forming steel with oxidation resistance for automobiles and a hot-forming process thereof.

BACKGROUND ART

In recent years, new materials for bodywork have been continuously developed and applied to car bodies. However, ultra-high strength steel plates for cold stamping at strength levels above 1000 MPa are often used for manufacturing components with simple shapes due to the constraints of easy cracking and large springback. However, the hot-forming steel is formed in an austenite zone by using hot-forming process, and has small springback, which can meet the requirements of assembly accuracy. Through pressure-holding and quenching, the ultra-high strength components of 1500 MPa level and above can be obtained, which effectively simplifies the design of body structure and parts, and greatly reduces the weight of the vehicle.

At present, hot-forming steels on the market can be classified as coated hot-forming steels and uncoated hot-forming steels according to their surface conditions. The uncoated steel is easy to form scale on its surface and suffers from decarburization when being heated in a heating furnace, which affects the performance of the steel; therefore, it is necessary to use protective atmosphere during heating of the hot-forming steel, and to make the shot peening treatment after hot forming, which increases the cost and working procedures. While the coated steel has an aluminum-silicon coating or zinc-based coating on the surface of the steel plate, which can effectively prevent the steel from surface decarburization and oxidation during heating, and the steel after hot forming can be exempted from the shot peening process, but the cost of the coated hot-forming steel is higher than the uncoated steel. At present, the strengthen level used for mass production and use of the hot-forming steel in the prior art is 1500 MPa; however, the elongation of the hot-forming steel after hot forming is only about 6-9%, and no better technology is available to keep a lower cost of the hot-forming steel, to solve the problem of surface oxidation and decarburization of the steel after hot forming, and to avoid the shot peening process, moreover, the hot-forming steel also has ultra-high strength and good plasticity.

The patent with the Publication No. being CN106811689B proposes a method for preparing a hot-forming steel with a tensile strength ≥2000 MPa, the hot-rolled substrate prepared by the method has lower strength and higher elongation, which is beneficial to the shear blanking before hot forming, and the tensile strength of the steel plate after hot forming can reach greater than 2000 MPa, but the Si content in its chemical composition is high, which is not beneficial to obtaining good surface quality. Moreover, only the traditional hot-forming process is adopted, gas protection and shot peening are still required, although the strength of the steel plate after hot forming is high, its elongation is lower than 9%.

The patent with Publication No. being CN106119693B proposes a hot-forming steel with a tensile strength ≥2100 MPa directly rolled by thin slab and a production method thereof, after treatments of smelting, hot rolling and hot forming process, the steel plate can reach a tensile strength of being greater than 2100 MPa, but the production process and hot-forming process of the steel plate are controlled by the traditional process, and the elongation of the steel plate after hot forming is lower than 6%, which does not have the performance characteristics of high strength and high plasticity, and does not meet the requirements of the whole process and low-cost process without gas protection and shot blasting.

The patent with Publication No. being CN103255340B proposes a high-strength and tough hot-forming steel plate for automobiles and a preparation method thereof. Chemical compositions of the steel sheet include C: 0.1-0.5%, Si: 0.5-1.5%, Mn: 1.2-2.4%, Ti: 0.01-0.05%, B: 0.001-0.005%, S: ≤0.01%, and P: ≤0.01%. After hot-forming, the tensile strength of the steel plate reaches 1600 MPa and the elongation reaches 16%, proving good comprehensive performance and relatively low alloy cost. However, the steel plate needs to be deformed during heating process, and then quenched twice to obtain the final microstructure and mechanical properties, which involves a complicated hot-forming process and is unable to be implemented through the existing equipment, moreover, it also needs gas protection during heating, and needs shot peening after hot forming.

To sum up, the development of high strength and high plasticity hot-forming process with good oxidation resistance and the hot forming technology for automobiles has good application prospects.

SUMMARY

According to the above technical problems, the present invention provides a high-strength and high-plasticity hot-forming steel with oxidation resistance for automobiles and a hot-forming process thereof.

A technical solution adopted by the present invention is as follows:

A high-strength and high-plasticity hot-forming steel with oxidation resistance for automobiles, where the hot-forming steel has chemical compositions in mass percentages as follows: C: 0.35%-0.50%, Si: ≤0.20%, Mn: 1.50%-2.50%, P: 0.050%-0.10%, S≤0.004%, Als: 0.02%-0.06%, Nb: 0.03%-0.07%, Ti: 0.020%-0.050%, V: 0.08%-0.15%, Cr: 1.50%-3.20%, Mo: 0.10%-0.30%, B: ≤0.0040%, N≤0.005%, the balance Fe and inevitable impurities.

A microstructure of the hot-forming steel includes a ferrite, a martensite and a retained austenite.

The ferrite has a volume fraction of 4%-10%, the martensite has a volume fraction of 78%-90%, and the retained austenite has a volume fraction of 6%-12%.

The hot-forming steel has an oxidation resistance rate ≤0.1 g/(m$^2$·h), an oxidation resistance up to Level 1, a tensile strength ≥2000 MPa, a yield strength ≥1400 MPa, and an elongation ≥12.0%. The surface of the steel is not completely decarburized with a thickness of decarburized layer ≤15 μm, and the hot-forming steel has a thickness of 0.8-12.0 mm.

Main role of the composition of the hot-forming steel disclosed in the present invention is as follows:

C: C is the guarantee of steel strength, which is beneficial to improving hardenability of the steel. If the carbon content is too low, the strength of the steel after hot stamping cannot reach the expected target. If the carbon content is too high, the strength of the steel after hot forming will be too high, and the plasticity will thus decrease. In addition, the increase of C content can reduce the phase transition temperature, so the austenitizing temperature of the steel will be lowered, which is beneficial to obtaining a shot blasting-free surface. At the same time, the increase of C content is beneficial to generating sufficient content of undercooled austenite during pressure holding of the hot-forming process and to improving the plasticity. Therefore, the optimal range of C in the present invention is 0.35%-0.50%.

Si: Si is an element without carbide precipitation in steel, which has a good inhibiting effect on carbide precipitation during cooling and pressure holding of the hot-forming process, thereby ensuring the content and stability of retained austenite. However, if the Si content is too high, a large number of defects such as scale and color difference will appear on the surface of the hot-forming substrate, which will affect the surface quality of hot-forming parts. At the same time, too high Si content will enlarge the two-phase region, raise the austenitizing temperature, and make the steel keep warm at a higher temperature, which is easy to deteriorate the surface of the steel. Therefore, the Si content proposed in the present invention is ≤0.20%.

Mn: Main role of Mn in this hot-forming steel is to improve the hardenability of the steel and reduce the phase transition temperature, so that the austenitization of the steel can be realized at a lower temperature. Too high content of Mn will deteriorate the microstructure uniformity of the steel, and easily cause serious banded structural defects in the microstructure. Therefore, the selected Mn content in the present invention is 1.50%-2.50%.

P: P can inhibit the formation of cementite and improve the stability of retained austenite, the role of which is similar to that of Si in this hot-forming steel. Also, P can have martensite laths refined, distribute it evenly and improve the toughness. The P content in the present invention is 0.050%-0.10%.

S: S is a harmful element in this hot-forming steel, and S will form MnS inclusions, which will deteriorate the microstructure and mechanical properties of the steel. Therefore, S is limited to ≤0.004% in the present invention.

Als: Als (acid-soluble aluminum) plays a role of deoxidization and nitrogen fixation in the smelting process, but too much Als will give rise to a large number of aluminum-based inclusions. The Als content in the present invention is 0.020%-0.060%.

Cr: Cr is an element for improving the hardenability of the steel. In the present invention, main role of Cr is to improve the high-temperature oxidation resistance of the steel and simultaneously improve the tempering stability of the steel, so as to ensure that the steel does not appear tempered martensite within the pressure-holding temperature range. The optimum Cr content falls between 1.50% and 3.20%.

Mo: Mo is a medium-strong carbide forming element that can improve the strength and toughness of the steel. In the present invention, Mo can lower the martensitic transformation temperature, significantly improve the stability of retained austenite, and at the same time, the addition of Mo element improves the oxidation resistance of the steel. The Mo content in the present invention is 0.10%-0.30%.

Nb, V: Nb and V mainly play the role of fine grain strengthening and precipitation strengthening in steel. In the present invention, Nb and V can effectively pin the original austenite grain boundary by diffusely precipitating the nano-scale fine carbides, thereby refining the structure of each phase in the hot-forming steel and improving the comprehensive performance. At the same time, the diffusely precipitated carbides can act as hydrogen traps to pin the diffusible hydrogen in the steel, which can improve the delayed fracture resistance of the steel. In addition, VN precipitation formed by V and N can inhibit BN precipitation and avoid the strength reduction caused by B precipitation. In the present invention, the Nb content is 0.030%-0.070%, and the V content is 0.080%-0.15%.

Ti: Ti is mainly used for fixing nitrogen in boron steel to ensure that the quenching effect of boron can be exerted. In addition, Ti can also form fine carbide precipitation with C element, which reduces the hardness and strength of martensite in the structure after hot forming, and is beneficial to improving the plasticity and toughness of the steel. The Ti content in the present invention falls between 0.020% and 0.050%.

B: Adding boron to the steel can significantly improve the hardenability of the steel and ensure the stability of steel strength after quenching. Too high B content is easy to form B compounds with N in the steel, which will reduce the performance of the steel. Therefore, the B content in the present invention is ≤0.0040%.

N: The lower the N content is, the better it becomes, but too low content of N will lead to production difficulties and increase the cost, so the N content in the present invention is ≤0.005%.

In the present invention, by adding alloying elements such as C, Mn, Cr, Mo, etc., the austenitizing temperature is lowered, the hardenability of the steel is improved, and the oxidation of the steel is propitious to be inhibited. At the same time, the critical cooling rate of the steel after hot forming is reduced, and is beneficial to the production of thick-specification hot-forming steel. In addition, through the combination of chemical composition and hot forming process, a certain content of ferrite can be obtained in the air-cooling stage, and a certain content of retained austenite with good stability can be obtained in the pressure-holding stage after cooling, which improves the plasticity of the steel. The addition of Si and P elements in the composition inhibits the precipitation of carbides, which guarantees the content of retained austenite in the steel and improves the mechanical properties of the steel. In addition, the Cr and Mo elements in the steel composition play an anti-oxidation role, so that the steel can be heated and kept warm under the condition of having no protective atmosphere, and can be subjected to the subsequent processes after hot forming directly without shot peening.

The present invention also discloses a hot-forming process of high-strength and high-plasticity hot-forming steel with oxidation resistance for automobiles, including the following steps:

(1) Placing the hot-forming substrate containing the above compositions into a heating furnace at a temperature of $A_{C3}$-$A_{C3}$+30° C. for heating and heat preservation for a period of 180 s-300 s, and the step is implemented to make the hot-forming substrate completely austenitic and make it have smaller original austenitic grain size; at the same time, lower austenitizing temperature is beneficial to reducing the surface oxidation of the hot-forming substrate;

(2) taking the heated hot-forming steel out of the heating furnace for air cooling to a temperature of Ara and staying for 3 s-5 s before being put into a hot-forming mold for deformation and cooling, at a cooling rate of ≥10° C./s, performing the pressure holding for 60 s-90 s after cooling to 250° C.-300° C., and taking out the formed parts for air-cooling to room temperature after pressure holding to obtain the hot-forming steel.

The above hot-forming substrate is obtained after smelting, hot rolling and cold rolling. The smelted composition and the mass percentage thereof are the composition and mass percentage of the aforesaid high-strength and high-plasticity hot-forming steel with oxidation resistance for automobiles.

The steel plate provided in the present invention does not need atmosphere protection during hot forming, does not need shot blasting treatment after hot forming, and can be subjected to the subsequent processes directly, and the whole process cost of the steel plate is lower than that of the existing hot-forming products.

Compared with the prior art, the present disclosure has the following advantages:

(1) through the combination of chemical composition and hot forming process provided in the present invention, a hot-forming steel with high-strength and high-plasticity can be obtained, the tensile strength of the steel is ≥2000 MPa, and the elongation reaches or exceeds 12%;

(2) by adding Cr element, the high temperature oxidation resistance of the steel is improved, the oxidation resistance rate of the steel is ≤0.1 g/(m$^2$·h), the oxidation resistance level reaches Level 1, and the steel does not need atmosphere protection during hot forming, does not need shot blasting treatment after hot forming and can be subjected to the subsequent processes directly; and (3) the proposed hot-forming steel and hot-forming process can be implemented through the existing equipment, without equipment modification and at a relatively low cost.

Based on the above reasons, the present invention can be widely popularized in the fields of automobile steel and the like.

DETAILED DESCRIPTION OF THE EMBODIMENTS

It should be noted that the embodiments of the present invention and features in the embodiments, under the condition of no conflict, can be combined with each other. The described embodiments are some, rather than all of the embodiments of the present disclosure. The following description of at least one example embodiment is merely illustrative in nature, and is in no way intended to limit the present disclosure, an application or use thereof. Based on the embodiments of the present disclosure, all other embodiments acquired by those of ordinary skill in the art without making creative efforts fall within the scope of protection of the present disclosure The present invention provides a high-strength and high-plasticity hot-forming steel with oxidation resistance for automobiles, where the hot-forming steel has chemical compositions in mass percentages as follows: C: 0.35%-0.50%, Si: ≤0.20%, Mn: 1.50%-2.50%, P: 0.050%-0.10%, S≤0.004%, Als: 0.02%-0.06%, Nb: 0.03%-0.07%, Ti: 0.020%-0.050%, V: 0.08%-0.15%, Cr: 1.50%-3.20%, Mo: 0.10%-0.30%, B: ≤0.0040%, N≤0.005%, the balance Fe and inevitable impurities.

A microstructure of the hot-forming steel includes a ferrite, a martensite and a retained austenite.

The ferrite has a volume fraction of 4%-10%, the martensite has a volume fraction of 78%-90%, and the retained austenite has a volume fraction of 6%-12%.

The hot-forming steel has an oxidation resistance rate ≤0.1 g/(m$^2$·h), an oxidation resistance up to Level 1, a tensile strength ≥2000 MPa, a yield strength ≥1400 MPa, and an elongation ≥12.0%. The surface of the steel is not completely decarburized with a thickness of decarburized layer ≤15 μm, and the hot-forming steel has a thickness of 0.8-12.0 mm.

After smelting, hot rolling and cold rolling, the high-strength hot-forming steel with excellent oxidation resistance provided in this embodiment obtains a hot-forming substrate with a thickness of 0.8-12.0 mm. Then, a hot-forming process is performed, and the hot-forming process includes the following steps:

(1) the hot-forming substrate containing the above compositions is placed into a heating furnace at a temperature of $A_{C3}$-$A_{C3}$+30° C. for heating and heat preservation for a period of 180 s-300 s, and the step is implemented to make the hot-forming substrate completely austenitic and make it have smaller original austenitic grain size; at the same time, lower austenitizing temperature is beneficial to reducing the surface oxidation of the hot-forming substrate; and (2) the heated hot-forming steel is taken out of the heating furnace for air cooling to a temperature of Ara and stayed for 3 s-5 s before being put into a hot-forming mold for deformation and cooling, at a cooling rate of ≥10° C./s, the pressure holding is performed for 60 s-90 s after cooling to 250° C.-300° C., and the formed parts is taken out for air cooling to room temperature after pressure holding to obtain the hot-forming steel.

The compositions, hot-forming process parameters, and the microstructure and performance of the steel after hot forming of the embodiments of the present invention are shown in Tables 1 to 3.

TABLE 1

Composition of Embodiment of the Present Invention (wt, %)

| Embodiment | C | Si | Mn | P | S | Als | Nb | V | Ti | Cr | Mo | B | N |
|---|---|---|---|---|---|---|---|---|---|---|---|---|---|
| 1 | 0.35 | 0.20 | 2.30 | 0.10 | 0.003 | 0.036 | 0.058 | 0.15 | 0.045 | 3.0 | 0.20 | 0.0040 | 0.003 |
| 2 | 0.37 | 0.17 | 2.50 | 0.092 | 0.002 | 0.020 | 0.070 | 0.13 | 0.050 | 3.2 | 0.10 | 0.0033 | 0.005 |
| 3 | 0.39 | 0.12 | 1.90 | 0.085 | 0.003 | 0.035 | 0.065 | 0.11 | 0.040 | 2.5 | 0.30 | 0.0025 | 0.003 |
| 4 | 0.42 | 0.05 | 1.85 | 0.074 | 0.002 | 0.041 | 0.053 | 0.10 | 0.036 | 2.3 | 0.15 | 0.0020 | 0.002 |
| 5 | 0.44 | 0.08 | 1.78 | 0.065 | 0.004 | 0.055 | 0.045 | 0.090 | 0.028 | 1.80 | 0.25 | 0.0015 | 0.001 |
| 6 | 0.50 | 0.01 | 1.50 | 0.050 | 0.003 | 0.060 | 0.030 | 0.080 | 0.020 | 1.50 | 0.30 | 0.0005 | 0.001 |
| 7 | 0.46 | 0.10 | 2.10 | 0.080 | 0.003 | 0.032 | 0.040 | 0.14 | 0.030 | 2.8 | 0.25 | 0.0030 | 0.002 |
| 8 | 0.40 | 0.05 | 1.60 | 0.055 | 0.001 | 0.023 | 0.060 | 0.095 | 0.033 | 2.0 | 0.28 | 0.0001 | 0.002 |

TABLE 2

Hot-forming Process of Embodiment of the Present Invention

| Embodiment | $A_{C3}$, ° C. | Heating Temperature, ° C. | Heat Preservation Period, s | Residence Time of temperature $A_{r3}$, s | Cooling Rate, ° C./s | Pressure-holding Temperature, ° C. | Pressure-holding Time, s |
|---|---|---|---|---|---|---|---|
| 1 | 821 | 850 | 180 | 5 | 25 | 300 | 90 |
| 2 | 811 | 840 | 220 | 4 | 23 | 280 | 80 |
| 3 | 809 | 835 | 250 | 3 | 20 | 260 | 75 |
| 4 | 796 | 825 | 190 | 4 | 17 | 250 | 60 |
| 5 | 796 | 825 | 280 | 5 | 11 | 270 | 70 |
| 6 | 785 | 815 | 300 | 3 | 10 | 265 | 85 |
| 7 | 799 | 825 | 260 | 4 | 16 | 285 | 65 |
| 8 | 803 | 830 | 290 | 5 | 17 | 275 | 78 |

TABLE 3

Microstructure and performance parameters of Embodiment of the Present Invention

| Embodiment | Thickness, mm | Yield strength, MPa | Tensile strength, MPa | A (elongation), % | Volume fraction of ferrite, % | Volume fraction of martensite, % | Volume fraction of austenite, % | Oxidation resistance rate, g/(m$^2$ · h) | Thickness of decarburized layer, μm) |
|---|---|---|---|---|---|---|---|---|---|
| 1 | 0.8 | 1400 | 2010 | 20.5 | 10 | 78 | 12 | 0.10 | 9 |
| 2 | 1.2 | 1530 | 2030 | 18.0 | 7 | 86 | 7 | 0.07 | 13 |
| 3 | 1.4 | 1460 | 2045 | 15.5 | 9 | 83 | 8 | 0.06 | 7 |
| 4 | 7.0 | 1650 | 2060 | 16.5 | 8 | 83 | 9 | 0.05 | 13 |
| 5 | 12.0 | 1550 | 2080 | 14.0 | 5 | 85 | 10 | 0.06 | 15 |
| 6 | 10.0 | 1680 | 2120 | 13.0 | 4 | 90 | 6 | 0.03 | 4 |
| 7 | 2.0 | 1480 | 2070 | 17.5 | 7 | 85 | 8 | 0.09 | 11 |
| 8 | 5.0 | 1710 | 2180 | 12.0 | 5 | 86 | 9 | 0.08 | 2 |

Through the combination of new chemical composition and hot forming process provided in the embodiment of the present invention, a hot-forming steel with high-strength and high-plasticity can be obtained, the tensile strength of the steel is ≥2000 MPa, and the elongation reaches or exceeds 12%; by adding Cr, Mo and other elements, the oxidation resistance of the steel is improved, the oxidation resistance rate of the steel is ≤0.1 g/(m$^2$·h), the oxidation resistance level reaches Level 1, and the steel does not need atmosphere protection during hot forming, does not need shot blasting treatment after hot forming, and can be subjected to the subsequent processes directly. Moreover, the proposed hot-forming steel and hot-forming process is lower in the whole process cost than that of the existing hot-forming products, and can be implemented through the existing equipment, without equipment modification.

At last, it should be noted that the above various embodiments are merely intended to illustrate the technical solution of the present disclosure and not to limit the same; although the present disclosure has been described in detail with reference to the foregoing embodiments, it should be understood by those ordinary skilled in the art that the technical solutions described in the foregoing embodiments may be modified or equivalents may be substituted for some or all of the technical features thereof; and the modification or substitution does not make the essence of the corresponding technical solution deviate from the scope of the technical solution of each embodiment of the present disclosure.

What is claimed is:

1. A hot-forming steel with oxidation resistance for automobiles, wherein the hot-forming steel has chemical compositions in mass percentages as follows: C: 0.35%-0.50%, Si: ≤0.20%, Mn: 1.50%-2.50%, P: 0.050%-0.10%, S≤0.004%, Als: 0.02%-0.06%, Nb: 0.03%-0.07%, Ti: 0.020%-0.050%, V: 0.08%-0.15%, Cr: 1.50%-3.20%, Mo: 0.10%-0.30%, B: ≤0.0040%, N≤0.005%, the balance Fe and inevitable impurities.

2. The hot-forming steel with oxidation resistance for automobiles according to claim 1, wherein a microstructure of the hot-forming steel includes a ferrite, a martensite and a retained austenite.

3. The hot-forming steel with oxidation resistance for automobiles according to claim 2, wherein the ferrite has a volume fraction of 4%-10%, the martensite has a volume fraction of 78%-90%, and the retained austenite has a volume fraction of 6%-12%.

4. The hot-forming steel with oxidation resistance for automobiles according to claim 1, wherein the tensile strength of the hot-forming steel is ≥2000 MPa.

5. The hot-forming steel with oxidation resistance for automobiles according to claim 1, wherein the oxidation resistance rate of the hot-forming steel is ≤0.1 g/(m$^2$·h).

6. The hot-forming steel with oxidation resistance for automobiles according to claim 1, wherein the yield strength of the hot-forming steel is ≥1400 MPa.

7. The hot-forming steel with oxidation resistance for automobiles according to claim 1, wherein the elongation of the hot-forming steel is ≥12.0%.

8. The hot-forming steel with oxidation resistance for automobiles according to claim 1, wherein the surface of the hot-forming steel is not completely decarburized with a thickness of decarburized layer≤15 μm.

9. The hot-forming steel with oxidation resistance for automobiles according to claim 1, wherein the thickness of the hot-forming steel is 0.8 mm-12.0 mm.

10. A hot-forming process of hot-forming steel with oxidation resistance for automobiles, comprising:

(1) placing a substrate of the hot-forming steel according to claim 1 into a heating furnace at a temperature of $A_{C3}$-$A_{C3}$+30° C. for heating and heat preservation for a period of 180 s-300 s; and (2) taking the heated substrate of the hot-forming steel out of the heating furnace for air cooling to a temperature of $A_{r3}$ and staying-holding for 3 s-5 s, then putting the substrate into a hot-forming mold for deformation and cooling to 250° C.-300° C. at a cooling rate of ≥10°

C./s, and then performing pressure holding to the cooled substrate for 60 s-90 s, followed by taking out the substrate for air cooling to room temperature after the pressure holding.

* * * * *